US006786793B1

(12) United States Patent
Wang

(10) Patent No.: US 6,786,793 B1
(45) Date of Patent: Sep. 7, 2004

(54) MOTION-GENERATING ILLUMINATED INFLATABLE DECORATION

(76) Inventor: Sheng-Chien Wang, No. 1, Lane 19, Shenlin Rd., Lin 8, Chuangchien Village, Shenkang Hsiang, Taichung Hsien (TW)

( * ) Notice: Subject to any disclaimer, the term of this patent is extended or adjusted under 35 U.S.C. 154(b) by 0 days.

(21) Appl. No.: 10/705,979

(22) Filed: Nov. 13, 2003

(51) Int. Cl.[7] ..... A63H 3/06; G09F 19/08
(52) U.S. Cl. ..... 446/226; 446/176; 40/412
(58) Field of Search ..... 446/353, 178, 446/176, 220–226, 397; 40/406, 412, 414, 419, 439

(56) References Cited

U.S. PATENT DOCUMENTS 2,698,499 A * 1/1955 Dygon ..... 446/198
5,045,015 A * 9/1991 Arad et al. ..... 446/355
5,115,472 A * 5/1992 Park et al. ..... 381/152
5,186,675 A * 2/1993 D. Stoddard ..... 446/199
5,205,774 A * 4/1993 Smrt ..... 446/199
5,335,436 A * 8/1994 Gurr ..... 40/412
5,378,188 A * 1/1995 Clark ..... 446/330
5,467,543 A * 11/1995 Fink et al. ..... 40/538
6,186,857 B1 * 2/2001 Gazit et al. ..... 446/226
6,296,543 B1 * 10/2001 Andrews ..... 446/334
6,447,361 B1 * 9/2002 Akiyama ..... 446/226
6,644,843 B2 * 11/2003 Chin-Cheng ..... 362/97
2002/0094746 A1 * 7/2002 Harlev ..... 446/178

* cited by examiner

*Primary Examiner*—Jacob K. Ackun
*Assistant Examiner*—Faye Francis
(74) *Attorney, Agent, or Firm*—Troxell Law Office PLLC

(57) ABSTRACT

A motion-generating illuminated inflatable decoration includes an inflatable body with an inner space mounted on the mounting base, an air pump and a dynamic controlling device. The air pump is mounted in the inner space to pump ambient air into the inner space. The dynamic controlling device is mounted in the inflatable body and includes a pulling cord, a cord driving motor, multiple illuminating elements, a controller and a sensor. The pulling cord interconnects the inflatable body with the cord driving motor and will cause a motion of the inflatable body as the cord driving motor is rotated to change its length. The illuminating elements are mounted on the inflatable body to produce lights. The controller controls the cord driving motor and the illuminating elements to work as the sensor detects a person going through the inflatable decoration to attract the person's attention.

7 Claims, 4 Drawing Sheets

MOTION-GENERATING ILLUMINATED INFLATABLE DECORATION

BACKGROUND OF THE INVENTION

1. Field of the Invention

The present invention relates to an inflatable decoration, and more particularly to an illuminated inflatable decoration that will produce a motion by itself as a passer-by goes through the inflatable decoration.

2. Description of Related Art

Decorations at exhibitions, fairs etc are often inflatable objects because they are convenient to store and transport when deflated yet can rapidly be expanded to a huge, eye-catching size. An inflatable object in accordance with prior art comprises a gastight inflatable body, a mounting base and an air pump. The inflatable body is mounted on the mounting base and is built into a significant shape, such as a cartoon figure, an inanimate animal-like object or a mascot etc to improve its attraction. The mounting base is placed on the ground to stand the entire inflatable object. The air pump connects to the inflatable body via hollow tubes and pumps ambient air into the inflatable body to swell or distend the inflatable body to become a huge size.

However, a conventional inflatable object is static for display and has no capability to provide any illuminated features. Such a conventional inflatable object is going to finally become unattractive to the crowds at the exhibition. In addition, especially in a dark place, the conventional inflatable object is hard to see clearly and cannot attract effectively the attention of people.

To overcome the shortcomings, the present invention provides an improved illuminated and dynamic inflatable object to mitigate or obviate the aforementioned problems.

SUMMARY OF THE INVENTION

The main objective of the invention is to provide an inflatable decoration that will cause attractive motions, such as waving hands, produce blinking lights and sound to attract attention when a person passes through the inflatable decoration such that will increase business promotion and advertisement effects for the inflatable decoration.

The inflatable decoration comprises an inflatable body and a dynamic controlling device mounted in the inflatable body. The dynamic controlling device comprises a pulling cord connecting to the inflatable body, a cord driving motor used to change a length of the pulling cord, multiple illuminating elements mounted on the inflatable body to produce lights, a speaker to produce sound, a controller used to control the cord driving motor, the illuminating elements and the speaker to work and a sensor electrically connected to the controller to detect the motion of a passer-by. Therefore, when a person goes through the inflatable decoration, the motion of the person will be detected by the sensor such that the controller actuates the cord driving motor, the illuminating elements and the speaker to cause a motion for the inflatable body, lights for inflatable decoration and sound.

Other objectives, advantages and novel features of the invention will become more apparent from the following detailed description when taken in conjunction with the accompanying drawings.

DETAILED DESCRIPTION OF PREFERRED EMBODIMENT

Figure 1:
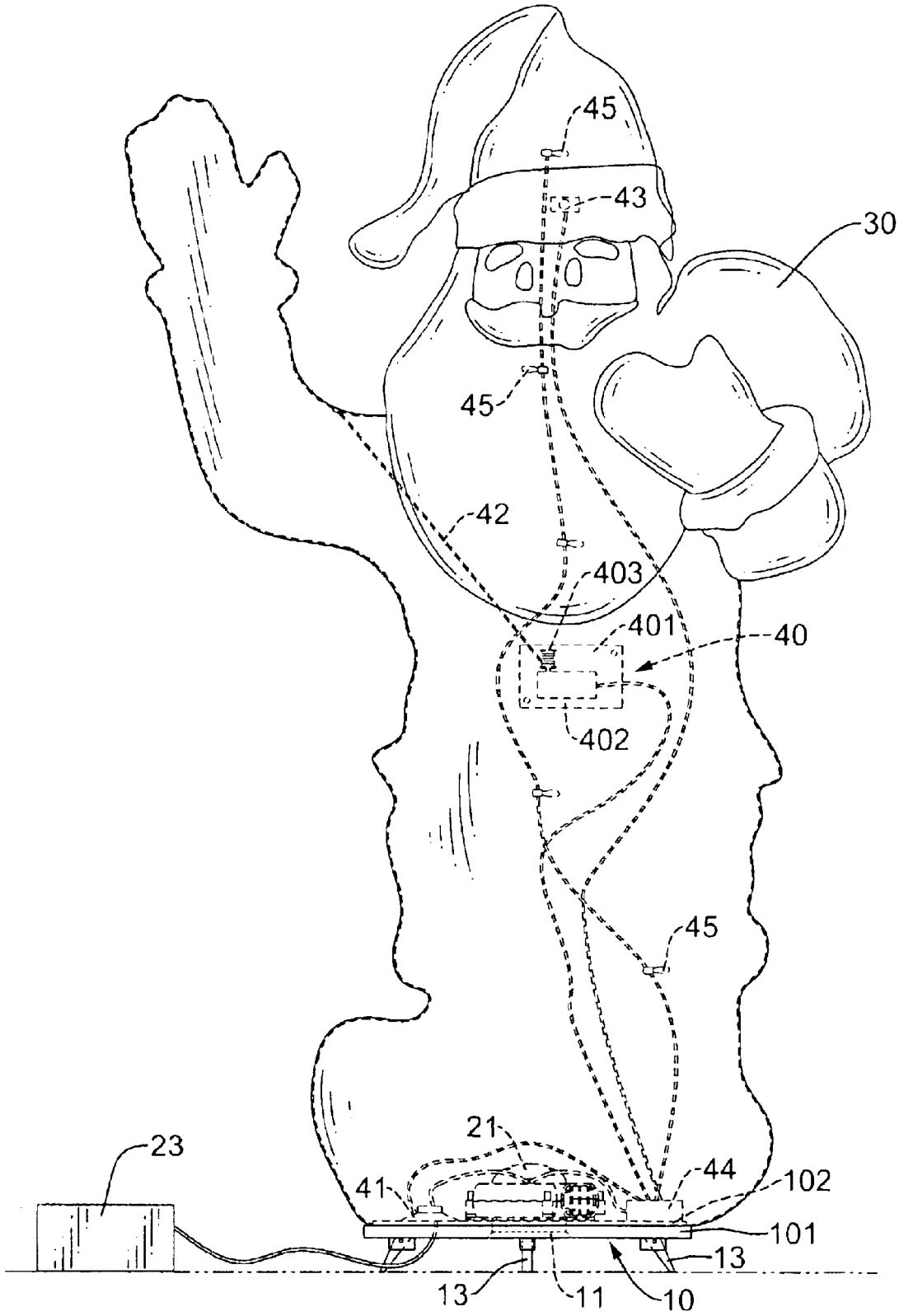
FIG. 1 is a front plan view of a motion-generating illuminated inflatable decoration in accordance with the present invention.
Figure 2:
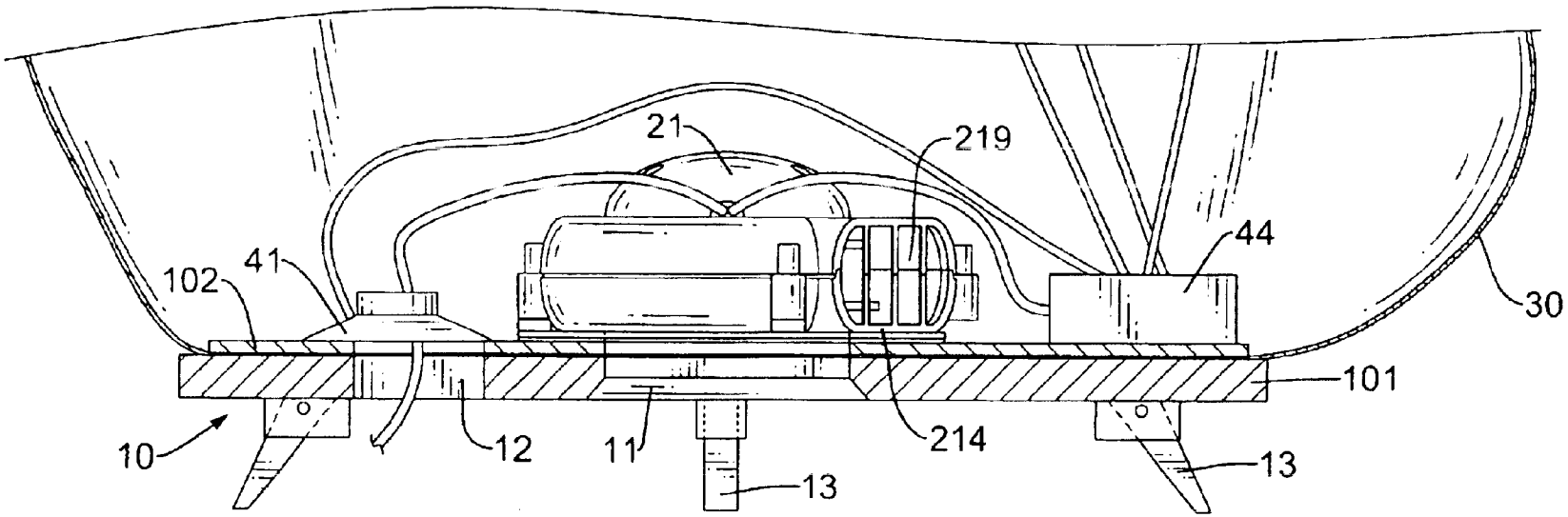
FIG. 2 is an enlarged plan view of a mounting base of the inflatable decoration in FIG. 1, partially in cross section.

With reference to FIGS. 1 and 2, a motion-generating illuminated inflatable decoration in accordance with the present invention comprises a mounting base (10), an air pump (21), a dynamic controlling device (not numbered), an inflatable body (30) and a power supply (23).

The mounting base (10) has an intake air entrance (11) and a sound outlet aperture (12) and comprises a weighted frame (101), a back plate (102) and multiple foldable feet (13). The weighted frame (101) has a top (not numbered), a bottom (not numbered) and a heavy weight to provide a reliable and stable support to the inflatable body (30). The back plate (102) is attached to the top of the weighted frame (101) to fasten and clamp a small portion of the inflatable body (30) and has a top (not numbered). The foldable feet (13) are pivotally mounted on the bottom of the weighted frame (101) such that the mounting base (10) will have a small size to be convenient to store when the foldable feet (13) are folded.

The intake air entrance (11) and the sound outlet aperture (12) are respectively defined through the top of the back plate (102), the clamped portion of the inflatable body (30) and the bottom of the weighted frame (101). The inflatable body (30) is mounted on the mounting base (10) and has a bottom (not numbered), an interior periphery (not numbered) with a desired exercising position (not shown), and an inner space (not numbered). In addition, the inflatable body (30) can be made of soft, resilient, light transmittable such as transparent or translucent and gastight materials and can be shaped into any significant figures, such as a human figure (not numbered) with two arms (not numbered) illustrated in the drawings for example. For convenient illustrating purpose only, when the inflatable body (30) is shaped into aforesaid human figure, the desired exercising position is located at one of the arms that tends to make a beckoning gesture for the inflatable body (30). The bottom of the inflatable body (30) is clamped and held between the back plate (102) and weighted frame (101) as previously described.

Figure 3:
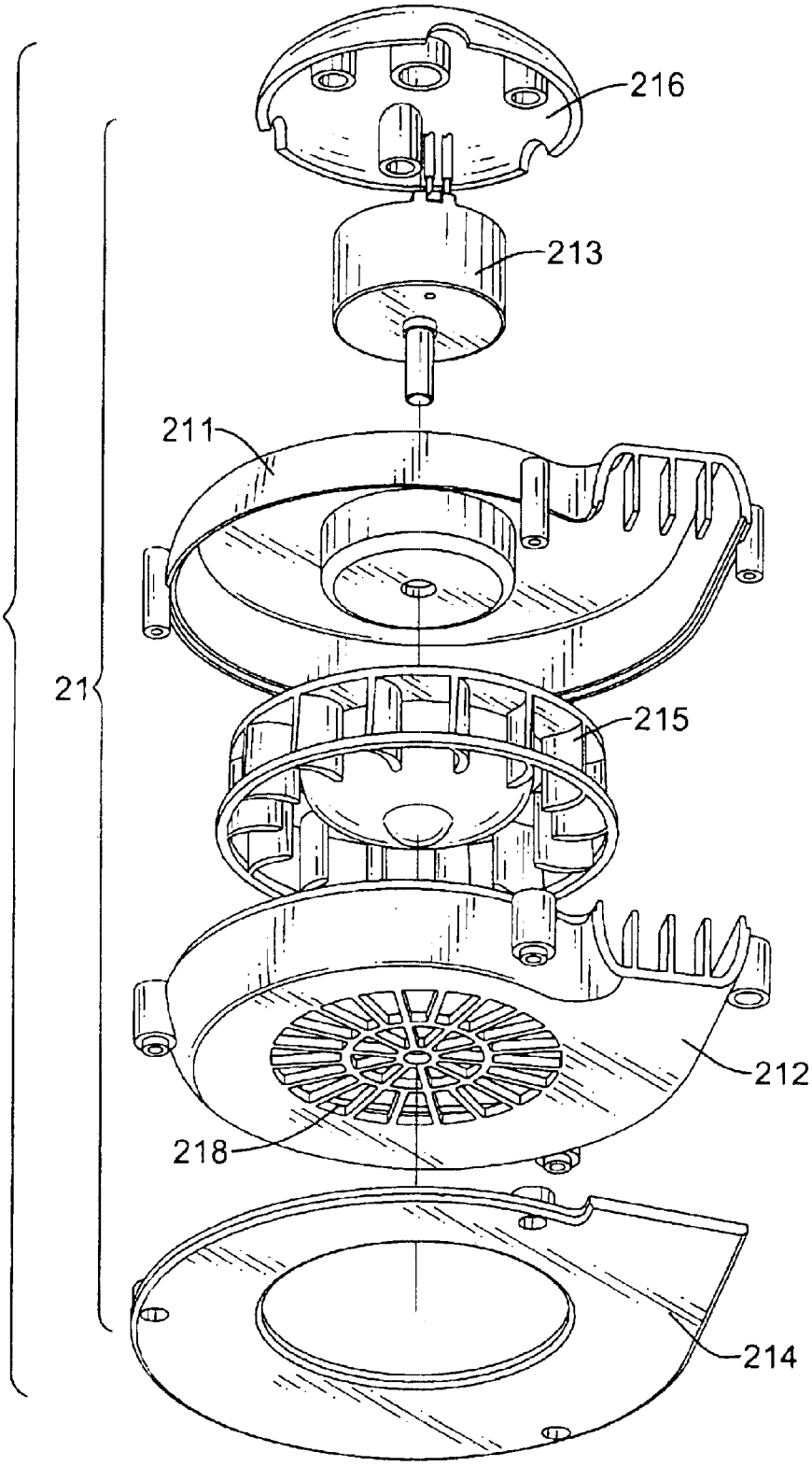
FIG. 3 is an exploded perspective view of an air pump of the inflatable decoration in FIG. 1.

With reference to FIGS. 2 and 3, the air pump (21) is a built-in device and is mounted in the inner space of the inflatable body (30) to connect to the intake air entrance (11) of the mounting base (10). The air pump (21) is mounted on the top of the back plate (102) and comprises a hollow body (not numbered), a motor (213), a fan (215), a motor housing (216) and a mounting bracket (214). The mounting bracket (214) is mounted on the top of the back plate (102) and has a through hole (not numbered) aligned with the intake air entrance (11). The hollow body is mounted on the mounting bracket (214), and has a top (not numbered), a bottom (not numbered), an outer edge (not numbered), an air inlet (218), an air outlet (219) and comprises an upper half housing (211) and a lower half housing (212). The upper and the lower half housings (211, 212) connect to each other. The air inlet (218) is defined in the bottom and is aligned with the through hole of the mounting bracket (214). The air outlet (219) is tangentially formed at the outer edge and communicates with the inner space of the inflatable body (30). The motor (213) is mounted on the top of the hollow body and has a shaft (not numbered) that passes through the top of the hollow body and extends into the hollow body. The fan (215) is rotatably mounted in the hollow body, connects to the motor shaft and is rotated by the motor (213) to draw air into the hollow body through the air inlet (218) and force the drawn air out of the hollow body through the air outlet (219) into the inner space of the inflatable body (30). The motor housing (216) is attached to the top of the hollow body to enclose the motor (213).

With reference to FIGS. 1 and 2, the dynamic controlling device is mounted in the inner space of the inflatable body (30) and comprises a cord driving motor assembly (40), a speaker (41), a pulling cord (42), an illuminated device (not numbered), a sensor (43) and a controller (44) mounted on the top of the back plate (102). The cord driving motor assembly (40) is mounted on the interior periphery of the inflatable body (30) and has a mounting frame (401), a cord driving motor (402) with a shaft (not numbered) and a bobbin (403) attached to the motor shaft. The cord driving motor (402) connects electrically to the controller (44) and is controlled by the controller (44) to rotate in either counterclockwise or clockwise directions or stop the shaft.

The pulling cord (42), such as a stainless steel cord interconnects the interior periphery of the inflatable body (30) with the shaft of the cord driving motor (402) and has a distal end (not numbered) and a proximal end (not numbered). The proximal end is wrapped around the bobbin (403) on the shaft of the cord driving motor (402). The distal end is fastened at the desired exercising position of the interior periphery of the inflatable body (30) to pull the desired exercising position to cause a motion for the inflatable body (30), such as waving its hands. Therefore, the pulling cord (42) will cause a motion at the desired exercising position as the cord driving motor (402) rotate the shaft to change the length of the pulling cord (42).

The illuminated device is mounted on the interior periphery of the inflatable body (30), connects electrically to the controller (44) and is controlled by the controller (44) to produce lights, such as blinking lights. The illuminated device has multiple illuminating elements (45), such as light bulbs or light emitting diodes (LEDs) that are respectively mounted on the interior periphery of the inflatable body (30) and connect respectively to the controller (44) to produce blinking lights.

The sensor (43) electrically connects to the controller (44) and is mounted on the inflatable body (30) at a detectable height with respect to the height of a normal human to detect a person who goes past the inflatable body (30). The power supply (23) is mounted outside the inflatable body (30) to provide an electricity support for the air pump (21) and the controller (44) that actuates the motor (402), the illuminating elements (45) and the speaker (41).

Consequently, the foldable feet (13) are spread to stand the inflatable decoration on the ground, then the air pump (21) is started to pump continuously the atmospheric air into the inner space of the inflatable body (30) to swell the inflatable body (30) to become a human shape. Since the air pump (21) continuously pumps the air into the inflatable body (30), the inflatable body (30) will be maintained with a stable shape.

Figure 4:
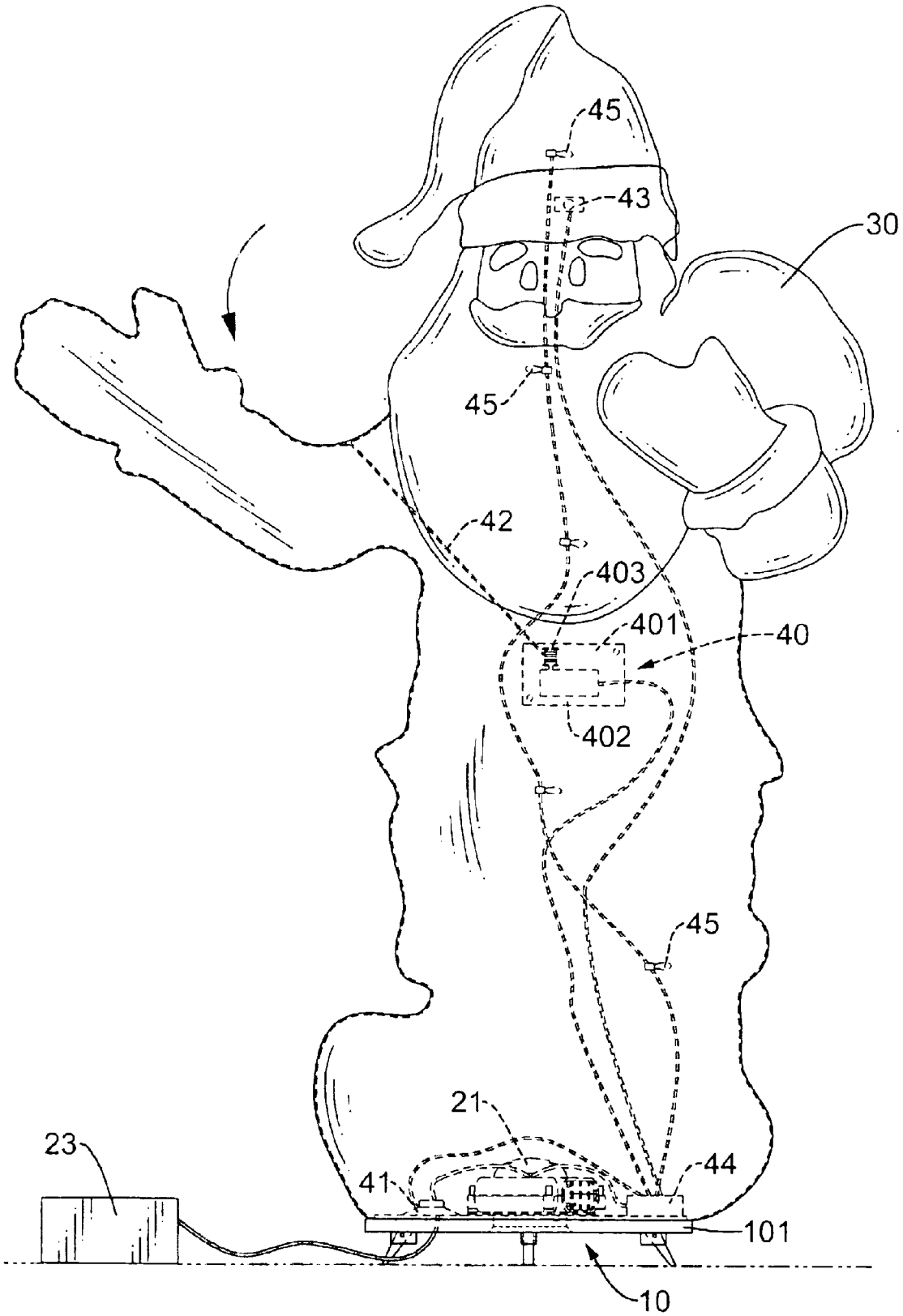
FIG. 4 is an operational perspective view of the inflatable decoration in FIG. 1, showing a dynamic controlling device actuate the inflatable decoration to waves its hand.

With reference to FIG. 4, when a passer-by (not shown) goes through the inflatable decoration and the sensor (43) detects the motion of the passer-by, the controller (44) will actuate the speaker (41) to produce sound, the illuminating elements (45) to produce blinking lights and the cord driving motor (402) to rotate intermittently the bobbin (403) in both directions. The rotation of the bobbin (403) will change simultaneously the length of the pulling cord (42) to make a beckoning gesture for the inflatable body (30). With those visible blinking lights, sounds and dynamic postures of the inflatable decoration, the inflatable decoration in accordance with the present invention becomes more decorative and attractive than a prior one. For an exhibition or a children's playground, the inflatable decoration in accordance with the present invention provide multiple effects for business advertisements and promotions.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A motion-generating illuminated inflatable decoration comprising:

a mounting base having an intake air entrance;

an inflatable body mounted on the mounting base, made of resilient material and having a bottom, an inner space and an interior periphery with a desired exercising position;

an air pump mounted in the inflatable body and connecting to the intake air entrance of the mounting base to pump air into the inflatable body via the intake air entrance;

a dynamic controlling device mounted in the inner space of the inflatable body and comprising a cord driving motor mounted on the interior periphery of the inflatable body and having a rotating shaft;

a pulling cord drawn by the cord driving motor and having a proximal end wrapped around the rotating shaft of the cord driving motor and a distal end fastened on the desired exercising position of the interior periphery of the inflatable body to cause a motion of the inflatable body at the desired exercising position;

a controller electrically connecting to the cord driving motor to selectively actuate the rotating shaft of the cord driving motor; and a sensor electrically connecting to the controller and mounted on the inflatable body at a detectable height to detect a person who goes past the inflatable decoration; and a power supply electrically connecting to both the controller and the air pump to provide an electricity supply for both the air pump and the controller.

2. The motion-generating illuminated inflatable decoration as claimed in claim 1, wherein the inflatable body is made of light transmittable material; and the dynamic controlling device further comprises an illuminated device electrically connected to the controller and has multiple illuminating elements mounted on the interior periphery of the inflatable body to produce blinking lights.

3. The motion-generating illuminated inflatable decoration as claimed in claim 1, wherein the dynamic controlling device further comprises a speaker electrically connected to the controller to produce sound.

4. The motion-generating illuminated inflatable decoration as claimed in claim 2, wherein the dynamic controlling device further comprises a speaker electrically connected to the controller to produce sound.

5. The motion-generating illuminated inflatable decoration as claimed in claim 4, wherein the speaker is mounted on the mounting base and the mounting base further has a sound outlet aperture corresponding to the speaker.

6. The motion-generating illuminated inflatable decoration as claimed in claim 5, wherein the inflatable body resembles a human figure with two arms, and the desired exercising position is located at one of the arms whereby the pulling cord moves the connected arm to make a beckoning gesture as the pulling cord is actuated by the cord driving motor.

7. The motion-generating illuminated inflatable decoration as claimed in claim 6, wherein the mounting base comprises a weighted frame, a back plate and multiple foldable feet, the weighted frame has a top, a bottom and a heavy weight to provide a reliable and stable support to the inflatable body, the back plate is attached to the top of the weighted frame to fasten and clamp the bottom of the inflatable body and the foldable feet are pivotally mounted on the bottom of the weighted frame; and the intake air entrance and the sound outlet aperture are respectively defined through the top of the back plate, the clamped bottom of the inflatable body and the bottom of the weighted frame.

* * * * *